US007972174B2

(12) United States Patent
Maruyama et al.

(10) Patent No.: US 7,972,174 B2
(45) Date of Patent: Jul. 5, 2011

(54) L-TYPE COAXIAL CONNECTOR

(75) Inventors: Yuichi Maruyama, Kyoto-fu (JP); Koji Saito, Kyoto-fu (JP); Katsumi Kohnishi, Shiga-ken (JP); Susumu Hashimoto, Osaka-fu (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/555,915

(22) Filed: Sep. 9, 2009

(65) Prior Publication Data

US 2010/0062640 A1 Mar. 11, 2010

(30) Foreign Application Priority Data

Sep. 10, 2008 (JP) ..... 2008-231757

(51) Int. Cl.
*H01R 9/05* (2006.01)

(52) U.S. Cl. ..... 439/582

(58) Field of Classification Search ..... 439/581, 439/582

See application file for complete search history.

(56) References Cited

U.S. PATENT DOCUMENTS

| | | | | |
|---|---|---|---|---|
| 5,263,877 | A * | 11/1993 | Mitani | 439/582 |
| 5,879,190 | A * | 3/1999 | Maruyama et al. | 439/581 |
| 6,508,668 | B1 * | 1/2003 | Yamane | 439/582 |
| 6,712,645 | B1 * | 3/2004 | Chou | 439/582 |

FOREIGN PATENT DOCUMENTS

| | | | |
|---|---|---|---|
| CN | 1691434 | A | 11/2005 |
| JP | 10-003968 | A | 1/1998 |
| JP | 11-307158 | | 11/1999 |
| JP | 2001-043939 | A | 2/2001 |
| JP | 2002-324636 | A | 11/2002 |
| JP | 2005-183212 | A | 7/2005 |
| JP | 2008-091046 | A | 4/2008 |

OTHER PUBLICATIONS

Japanese Office Action "Notification of Reasons for Rejection" dated Jul. 20, 2010; Japanese Patent Application No. 2008-231757; with translation.

The first Office Action from the State Intellectual Property Office of People's Republic of China dated Apr. 25, 2011; Chinese Patent Application No. 2009101734124; with translation.

* cited by examiner

*Primary Examiner* — Briggitte R Hammond

(74) *Attorney, Agent, or Firm* — Studebaker & Brackett PC; Tim L. Bracket, Jr.

(57) ABSTRACT

A housing includes a cylinder portion, a back portion, crimping portions, and supporting portions. The cylinder portion has a first opening, a second opening, and a cut and can be in contact with an external conductor of a receptacle inserted from the first opening. The back unit covers the second opening. Each of the supporting portions is disposed on the cylinder portion. Each of the crimping portions extends from the back portion and is bent so as to face the back portion such that the supporting portion is disposed between the crimping portion and the back portion. An elastic portion is disposed between the crimping portion and the supporting portion.

6 Claims, 21 Drawing Sheets

(a)

(b)

(a)

(b)

(c)

PRIOR ART

PRIOR ART

PRIOR ART

PRIOR ART

L-TYPE COAXIAL CONNECTOR

CROSS REFERENCE TO RELATED APPLICATIONS

The present application claims priority to Japanese Patent Application No. 2008-231757, filed Sep. 10, 2008, the entire contents of each of the application being incorporated herein by reference in its entirety.

BACKGROUND OF THE INVENTION

1. Field of the Invention

The present invention relates to L-type coaxial connectors. In particular, the present invention relates to an L-type coaxial connector that can be connected to and disconnected from a receptacle having a center conductor and an external conductor.

2. Description of the Related Art

Examples of known L-type coaxial connectors are described in Japanese Unexamined Patent Application Publication No. 2001-43939 (hereinafter referred to as JP 2001-43939) and in Japanese Unexamined Patent Application Publication No. 11-307158 (hereinafter referred to as JP 11-307158). FIG. 18 is an exploded perspective view of a coaxial connector 210 and a receptacle 230 described in JP 2001-43939. FIG. 19 is an exploded perspective view of a coaxial connector 310 described in JP 11-307158.

As shown in prior art FIG. 18, the coaxial connector 210 includes a housing 212, a bushing 214, and a socket 216. The coaxial connector 210 is attached to an end of a coaxial cable 220 and can be connected to and disconnected from the receptacle 230. The coaxial cable 220 has an outer conductor 222 and a center conductor 224. The receptacle 230 includes an external conductor 232 and a center conductor 234.

As further shown in FIG. 18, the housing 212 further includes a cylinder portion 226, a surrounding portion 227, a lid portion 228, and a crimping portion 229. The housing 212 is connected to an outer conductor 222 of the coaxial cable 220. The bushing 214 is made of an insulating material.

As further shown in FIG. 18, the bushing 214 is attached to the cylinder portion 226 and the surrounding portion 227 of the housing 212. The socket 216 is attached to the bushing 214 and connected to the center conductor 224 of the coaxial cable 220. After the bushing 214 and the socket 216 are attached to the housing 212, the lid portion 228 is closed and the crimping portion 229 is crimped. Thus, the cylinder portion 226, the lid portion 228, and the coaxial cable 220 are fixed to one another.

The coaxial connector 210 described in JP 2001-43939 has a problem in that even a slight force applied to the coaxial connector 210 or the coaxial cable 220 can disengage the coaxial connector 210 from the receptacle 230. FIG. 20 is a plan view of the coaxial connector 210.

More specifically, in attaching the coaxial connector 210 to the receptacle 230, the external conductor 232 of the receptacle 230 is inserted into the cylinder portion 226. At this time, the cylinder portion 226 is pushed and expanded by the external conductor 232 in the directions indicated by the arrows shown in FIG. 20, and the cylinder portion 226 is thus pressed into contact with the external conductor 232. This enables the coaxial connector 210 to be attached to and disconnected from the receptacle with a moderate force.

However, for the coaxial connector 210 described in JP 2001-43939, the force for causing the cylinder portion 226 to be pressed into contact with the external conductor 232 is insufficient. As shown in FIG. 20, a gap SP1 is present between the surrounding portion 227 and the crimping portion 229, and, thus, the surrounding portion 227 is not supported by the crimping portion 229. Because of this, in attaching the coaxial connector 210 to the receptacle 230, after the cylinder portion 226 is expanded in the directions indicated by the arrows shown in FIG. 20, the surrounding portion 227 is not supported by the crimping portion 229 and is also expanded largely. The force for causing the cylinder portion 226 to be pressed into contact with the external conductor 232 is not sufficiently large, so the coaxial connector 210 is apt to be disengaged from the receptacle 230.

The coaxial connector 310 shown in JP 11-307158 is described next. As shown in prior art FIG. 19, the coaxial connector 310 includes a housing 312, a bushing 314, and a socket 316 and is attached to the end of the coaxial cable 220.

As further shown in FIG. 19, the housing 312 includes a cylinder portion 326, a cover 327, a lid portion 328, and a crimping portion 329. The housing 312 is connectable to the outer conductor 222 of the coaxial cable 220. The bushing 314 is made of an insulating material. As shown in FIG. 19, the bushing 314 is attached to the cylinder portion 326 of the housing 312. The socket 316 is attached to the bushing 314 and connectable to the center conductor 224 of the coaxial cable 220. After the bushing 314 and the socket 316 are attached to the housing 312, the lid portion 328 is closed and the crimping portion 329 is crimped. Thus, the cylinder portion 326, the lid portion 328, and the coaxial cable 220 are fixed to one another.

To enable the coaxial connector 310 described in JP 11-307158 to be attachable to and detachable from the receptacle 230 with a moderate force, it is necessary to produce the housing 312 with high accuracy. FIG. 21 is a plan view of the coaxial connector 310.

More specifically, in attaching the coaxial connector 310 to the receptacle 230, the substantially cylindrical external conductor 232 of the receptacle 230 is inserted into the cylinder portion 326. At this time, the cylinder portion 326 is pushed and expanded by the external conductor 232 in the directions indicated by the arrows shown in FIG. 20, and the cylinder portion 326 is thus pressed into contact with the external conductor 232. This aims to enable the coaxial connector 310 to be attached to and disconnected from the receptacle with a moderate force.

However, for the coaxial connector 310 described in JP 11-307158, the cylinder portion 326 is less prone to being deformed. In order to enable the coaxial connector 310 to be connected to and disconnected from the receptacle 230 with a moderate force, it is necessary to produce the housing 312 with high accuracy. As shown in FIG. 21, the cover 327 is pressed by the crimping portion 329. Accordingly, in attaching the coaxial connector 310 to the receptacle 230, because the cover 327 is unable to expand due to pressing by the crimping portion 329, the cylinder portion 326 is unable to expand largely in the directions indicated by the arrows shown in FIG. 21. That is, the cylinder portion 326 can be deformed in a significantly narrow range. To enable the coaxial connector 310 to be connected to and disconnected from the receptacle 230 with a moderate force, the amount of deformation of the cylinder portion 326 after the external conductor 232 of the receptacle 230 is inserted into the cylinder portion 326 must fall within that narrow range. Therefore, it is necessary to produce the housing 312 with high accuracy.

SUMMARY OF THE INVENTION

Accordingly, it is an object of the present invention to provide an L-type coaxial connector that may be connected to and disconnected from a receptacle with a moderate force.

According to preferred embodiments of the present invention, an L-type coaxial connector may be attached to a coaxial cable and attached to and detached from a receptacle having a center conductor and an external conductor. In an embodiment of the present invention, the L-type coaxial connector includes a housing having a cylinder portion and a back portion, a supporting portion, and a crimping portion, the cylinder portion having a first opening and a second opening and being in contact with the external conductor inserted through the first opening, the back portion covering opening, the supporting portion disposed on the cylinder portion. The connector further includes a bushing attached to the housing, a socket attached to the bushing and connectable to the center conductor, the socket being insulated from the housing by the bushing, and an elastic portion. The crimping portion extends from the back portion and is bent so as to face the back unit such that the supporting unit is disposed between the crimping portion and the back portion. The elastic unit is disposed between the crimping portion and the supporting portion.

The preferred embodiments of the present invention provide an L-type coaxial connector that may be connected to and disconnected from a receptacle with a moderate force.

Other features, elements, characteristics and advantages of the present invention will become more apparent from the following detailed description of preferred embodiments of the present invention with reference to the attached drawings.

DESCRIPTION OF THE PREFERRED EMBODIMENTS

An L-type coaxial connector according to one embodiment of the present invention is described below with reference to the drawings.

Figure 1:
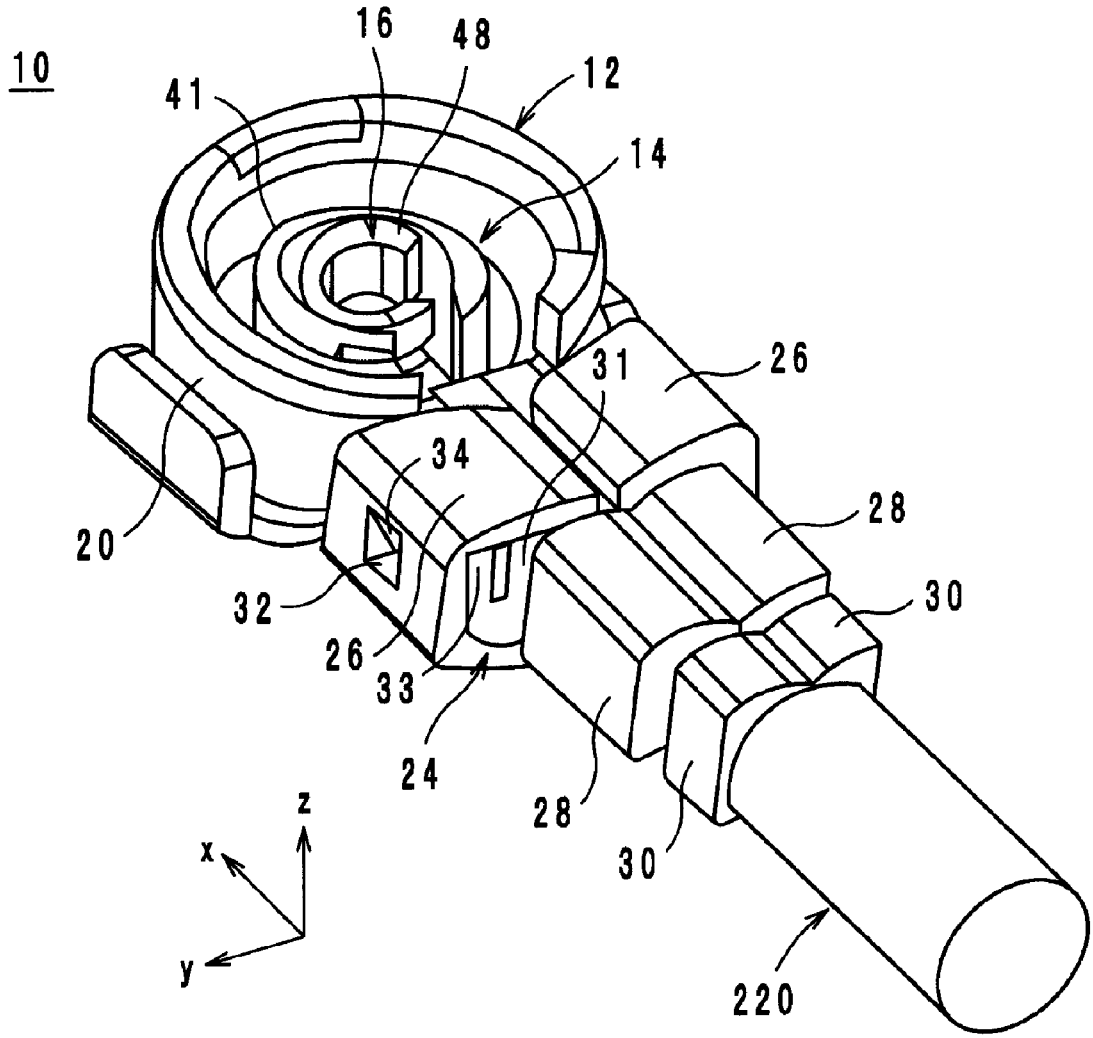
FIG. 1 is an external perspective view of an L-type coaxial connector according to an embodiment of the present invention.
Figure 2:
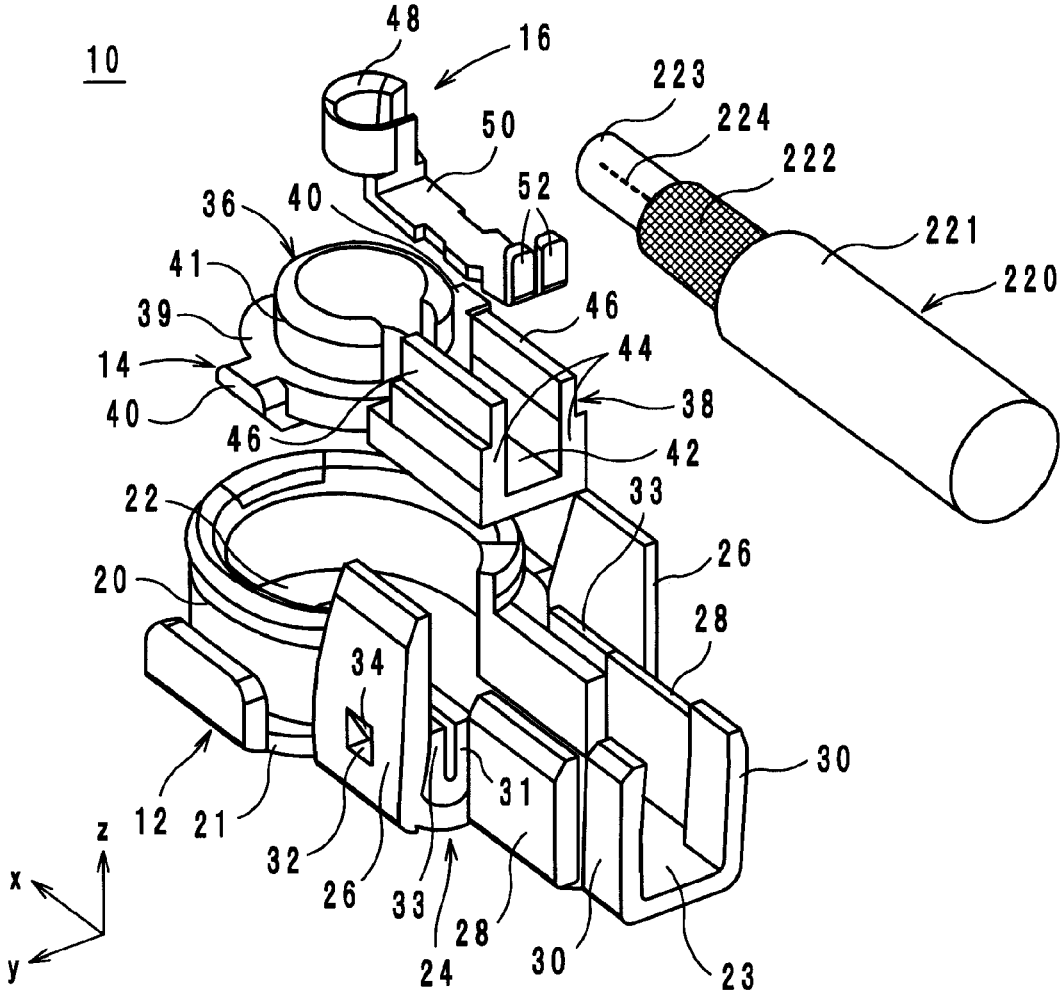
FIG. 2 is an exploded perspective view of the L-type coaxial connector shown in FIG. 1.
Figure 3A:
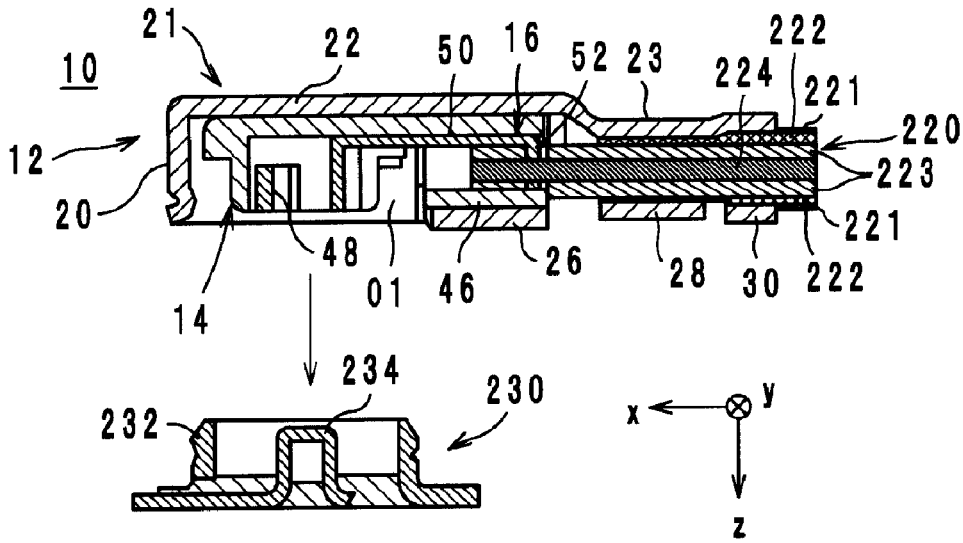
FIGS. 3A and 3B are a cross-sectional views of the L-type coaxial connector shown in FIG. 1.
Figure 3B:
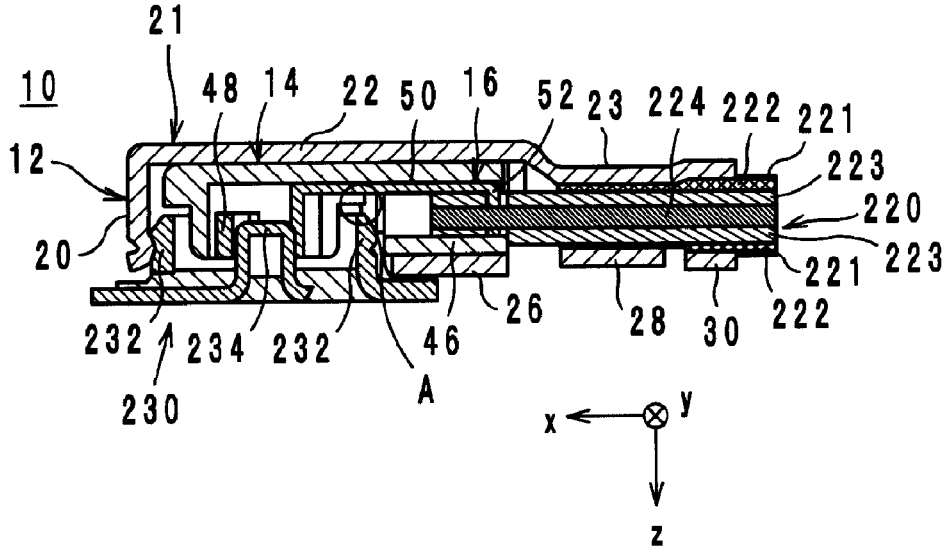
Figure 4:
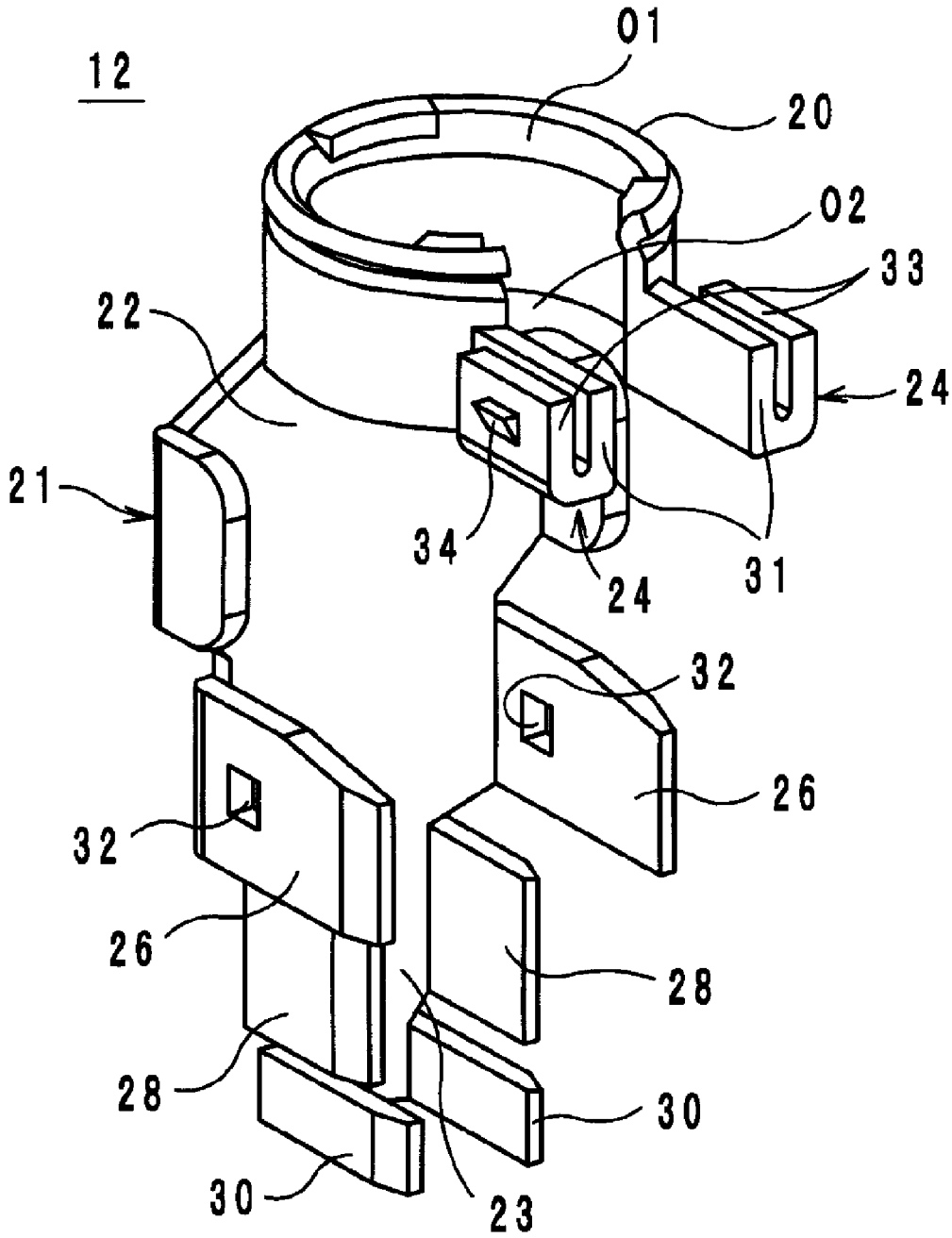
FIG. 4 is a perspective view of a housing of the L-type coaxial connector shown in FIG. 1 during assembling.
Figure 5:
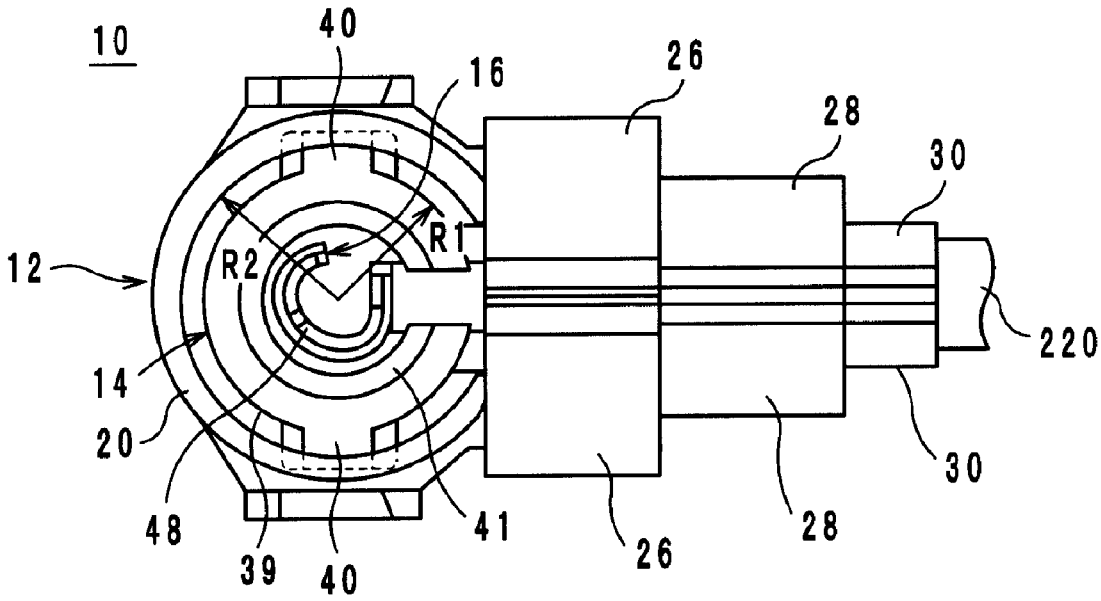
FIG. 5 is a plan view of the L-type coaxial connector shown in FIG. 1.

As summarized in the brief description of the drawings, FIG. 1 is an external perspective view of an L-type coaxial connector 10 according to an embodiment of the present invention. FIG. 2 is an exploded perspective view of the L-type coaxial connector 10. FIGS. 3A and 3B are cross-sectional views of the L-type coaxial connector 10. FIG. 4 is a perspective view of a housing 12 of the L-type coaxial connector 10 during assembling. FIG. 5 is a plan view of the L-type coaxial connector 10.

Hereinafter, the term "Z-direction" refers to a direction in which the housing 12, a bushing 14, and a socket 16 are superposed on one another as shown in FIGS. 1 to 3, in particular, FIG. 2. Hence, the direction from the housing 12 toward the socket 16 is the positive Z-direction.

Hereinafter, the term "X-direction" refers to a direction in which a coaxial cable 220 extends, and the term "Y-direction" refers to a direction perpendicular to an X-direction and a Z-direction. Hence, the direction from the coaxial cable 220 toward the socket 16 is the positive X-direction.

As shown in FIGS. 1 and 2, the L-type coaxial connector 10 includes the housing 12, the bushing 14, and the socket 16. The L-type coaxial connector 10 is attached to an end of the coaxial cable 220. The coaxial cable 220 includes an insulating film 221, an outer conductor 222, an insulating film 223, and a center conductor 224.

As shown in FIGS. 3A and 3B, the L-type coaxial connector 10 can be connected to and disconnected from the receptacle 230, which is known in the art and to which the present L-shaped coaxial connector 10 may be connected. The receptacle 230 is shown in prior art FIG. 18 with an external perspective view thereof. The receptacle 230 includes an external conductor 232 and a center conductor 234.

The housing 12 is made of a metal plate (e.g., phosphor bronze for springs) and includes a cylinder portion 20, a back portion 21, a fastening portion 24, and crimping portion 26, 28, and 30, as shown in FIGS. 2 and 4. The cylinder portion 20 includes a cut out portion or a partially removed portion (i.e., a part on the negative X-direction side). The cylinder portion 20 has an opening 01 on the positive z-direction side and an opening 02 on the negative z-direction side.

The back portion 21 is connected to the cylinder portion 20 and includes a lid portion 22 and an extension portion 23. The bushing 14 and the coaxial cable 220 are placed on the back portion 21. The lid portion 22 is a plate-shaped member connected to the cylinder portion 20. The lid portion 22 is bent approximately 90 degrees from the state shown in FIG. 4 so as to cover the opening 02 of the cylinder portion 20 as shown in FIG. 2. The extending unit 23 is a plate that extends in the negative x-axis direction from the lid 22.

The fastening portion 24 is connected to the cylinder portion 20 and includes supporting portion 31 and elastic portion 33. As shown in FIG. 2, the fastening portion 24 and the bushing 14 are arranged in a y-direction. As shown in FIG. 4, the supporting portions 31 are disposed at the ends of the cylinder portion 20 when the opening 01 is viewed from the positive z-direction. Specifically, the two supporting portions 31 are plate-shaped members extending in the negative x-direction from the two ends of the cylinder portion formed from the cut out portion of the cylinder portion 20. The supporting portions 31 face each other.

As shown in FIG. 4, the elastic portions 33 are plate-shaped members connected to the supporting portion 31 and, each of the elastic portions 33 faces the corresponding supporting portion 31. Specifically, each of the supporting portions 31 and the corresponding elastic portions 33 are formed by bending a plate-shaped member into a substantially U shape. A protruding portion 34 is formed on a side of each of the elastic portions 33 opposite to the side facing the corresponding supporting portion 31.

As shown in FIG. 2, the crimping portions 26 are plate-shaped members which extend in a direction perpendicular to the back portion 21 (i.e., z-direction) prior to the L-type coaxial connector 10 being assembled. Each of the crimping portions 26 faces the other with the back portion 21 therebetween. Each of the crimping portions 26 serves to fix the bushing 14, the socket 16, and the coaxial cable 220 to the housing 12 when the crimping portions 26 are in a bent position, as shown in FIG. 1.

As shown in FIG. 4, a recessed portion 32 is formed in each of the surfaces of the crimping portions 26 facing each other, as illustrated in FIG. 4. The recessed portion 32 shown in FIG. 4 is a hole extending through each of the crimping portions 26. The recessed portions 32 and the protruding portions 34 are engaged with each other when the back portion 21 is bent as shown in FIG. 1. Each pair of the recessed portions 32 and the protruding portions 34 constitute a holding mechanism that can maintain a state in which, by utilizing elasticity of the housing 12, the back portion 21 is in contact with the cylinder portion 20 and the lid portion 22 covers the opening 02, even when the crimping portions 26 are not bent. Alternatively, the recessed portions 32 may be formed on the elastic unit 33, and the projection 34 may be provided on the crimping portions 26.

As shown in FIG. 4, the crimping portions 28 and 30 are plate-shaped members extending in a direction perpendicular to the back portion 21 (i.e., Z-direction) before the L-type coaxial connector 10 is assembled. The crimping portions 28 are disposed in pairs so as to face each other with the back portion 21 therebetween, and so are the crimping portions 30. That is, the crimping portions 28 and the back portion 21 form a substantially angular U-shape, and so do the crimping portions 30. However, the crimping portions 28 and the back portion 21 may form, for example, a substantial U-shape, and so may the crimping portions 30. The crimping portions 28 and 30 serve to fix the coaxial cable 220 to the housing 12 by being bent as shown in FIG. 1.

As described above, the crimping portions 26, 28, and 30 extend in the positive Z-direction before the L-type coaxial connector 10 is assembled. Thus, as shown in FIG. 2, the back portion 21, on which the bushing 14 is to be placed, is exposed when viewed from the positive Z-direction.

The bushing 14 is formed of an insulator made of plastic, such as, for example, liquid crystal polymer, and serves to insulate the housing 12 and the socket 16 from each other. The bushing 14 is attached to the housing 12. As shown in FIG. 2, the bushing 14 includes a circular portion 36 and a holding portion 38.

The circular portion 36 serves to hold the socket 16. As shown in FIG. 2, the circular portion 36 includes a back portion 39, protruding portions 40, and a cylinder portion 41. The back portion 39 is a plate-shaped member that is circular in plan view from a Z-direction. As shown in FIG. 1, when the bushing 14 is attached to the housing 12, the back portion 39 is contained in the cylinder portion 20. That is, the protruding portions 40 are not included in the back portion 39. As shown in FIG. 5, the radius R1 of the back portion 39 is equal to or smaller than the radius R2 of the inner periphery of the cylinder portion 20. Thus, the back portion 39 can pass through the opening 01 in a Z-direction.

The protruding portions 40 extend from outer edges of the circular back portion 39 in directions extending outward from the center of the back portion 39 (i.e., in radial directions). The distance between the center of the back portion 39 and the tips of the protruding portions 40 is larger than the radius R2 of the inner periphery of the cylinder portion 20. Recessed portions (not shown) are formed in the inner periphery of the cylinder portion 20. As shown in FIG. 5, the protruding portions 40 are inserted into the recessed portions of the cylinder portion 20, when the bushing 14 is pressed into the housing 12 from the positive Z-direction as shown in FIG. 2. Thus, the bushing 14 is prevented from dropping off the housing 12.

As shown in FIG. 2, the cylinder portion 41 is disposed on a side of the back portion 39 facing the positive Z-direction. The cylinder portion 41 has a substantially annular shape with a cut out portion when viewed from a Z-direction. In FIG. 2, the cylinder portion 41 has a cut out portion at the position at which the holding portion 38 is connected to the cylinder portion 41.

The holding portion 38 serves to hold the socket 16. As shown in FIG. 2, the holding portion 38 includes a back portion 42, two supporting portions 44, and two lid portions 46. The back portion 42 is a substantially rectangular plate-shaped member extending in the negative X-direction from the back portion 39 of the circular portion 36. As shown in FIG. 2, the socket 16 is placed on the back portion 42.

As shown in FIG. 2, the supporting portions 44 are plate-shaped members extending from the back portion 42 in a direction perpendicular to the back portion 42 (i.e., Z-direction). The supporting portions 44 face each other with the back portion 42 therebetween. The supporting portions 44 serve to support the socket 16 so that the socket 16 is not moved in a Y-direction. The lid portions 46 are plate-shaped members each extending in the positive Z-direction from the corresponding supporting portion 44 before the L-type coaxial connector 10 is assembled. The lid portions 46 serve to fix the socket 16 and the coaxial cable 220 to the bushing 14 when bent together with the crimping portions 26 after the socket 16 and the coaxial cable 220 have been attached to the bushing 14.

The socket 16 is made of a metal plate, such as, for example, a phosphorus bronze plate used for springs. As shown in FIGS. 1 and 2, the socket 16 is attached to the bushing 14 and is insulated from the housing 12 through the bushing 14. As shown in FIG. 2, the socket 16 includes a cylinder portion 48, a back portion 50, and an attaching portion 52. As shown in FIG. 2, the cylinder portion 48 is connected to a positive X-direction side of the back portion 50. The cylinder portion 48 has a substantially annular shape with a cut out portion when viewed from a Z-direction. The radius of the cylinder portion 48 is smaller than the radius of the cylinder portion 41 of the bushing 14. Thus, the cylinder portion 48 can be contained in the cylinder portion 41 as shown in FIG. 1 when the L-type coaxial connector 10 is assembled.

The back portion 50 is a plate-shaped member extending in the negative X-direction from the cylinder portion 41. The attaching portion 52 is formed by bending, in the positive Z-direction, an end of the back portion 50 on the negative X-direction side. The attaching portion 52 is connected to the center conductor 224 of the coaxial cable 220. To be specific, the attaching portion 52 includes two cutting pieces disposed with a gap therebetween. The coaxial cable 220 is pressed against the attaching portion 52 in the negative Z-direction so that the center conductor 224 of the coaxial cable 220 is clamped in the gap of the attaching portion 52. The attaching portion 52 then pierces through the insulating film 223 of the coaxial cable 220, so that the attaching portion 52 is connected to the center conductor 224.

The L-type coaxial connector 10, which has the above-described structure, is assembled using the procedure described below.

Figure 6:
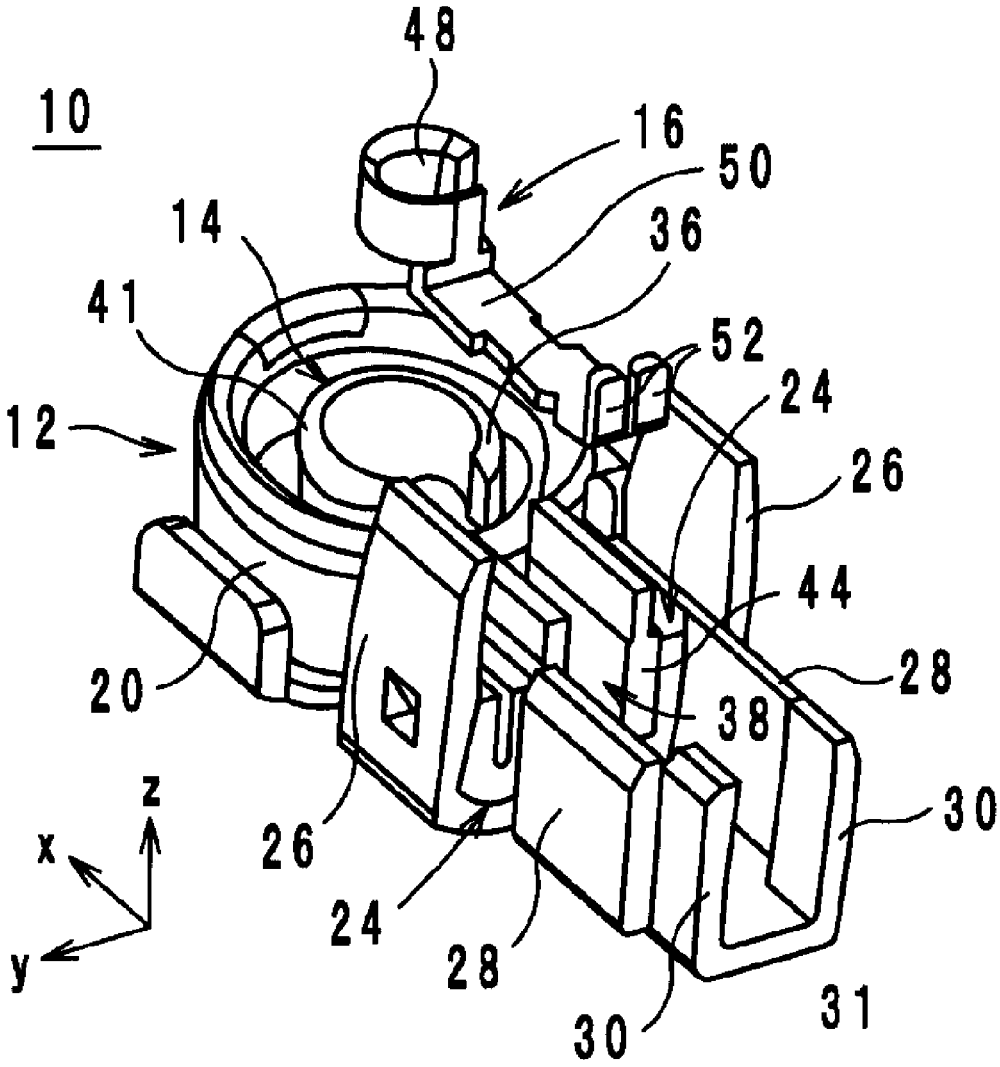
FIG. 6 is an exploded perspective view of the L-type coaxial connector shown in FIG. 1 during assembling.
Figure 7:
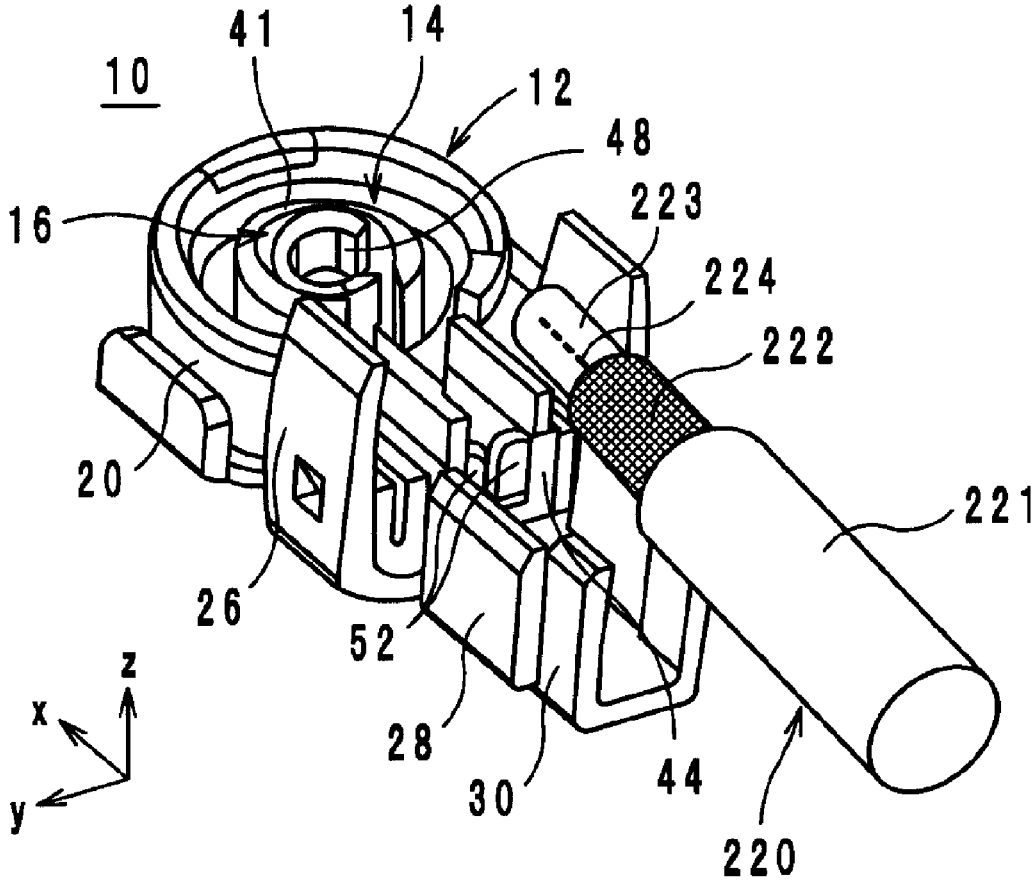
FIG. 7 is an exploded perspective view of the L-type coaxial connector shown in FIG. 1 during assembling.
Figure 8:
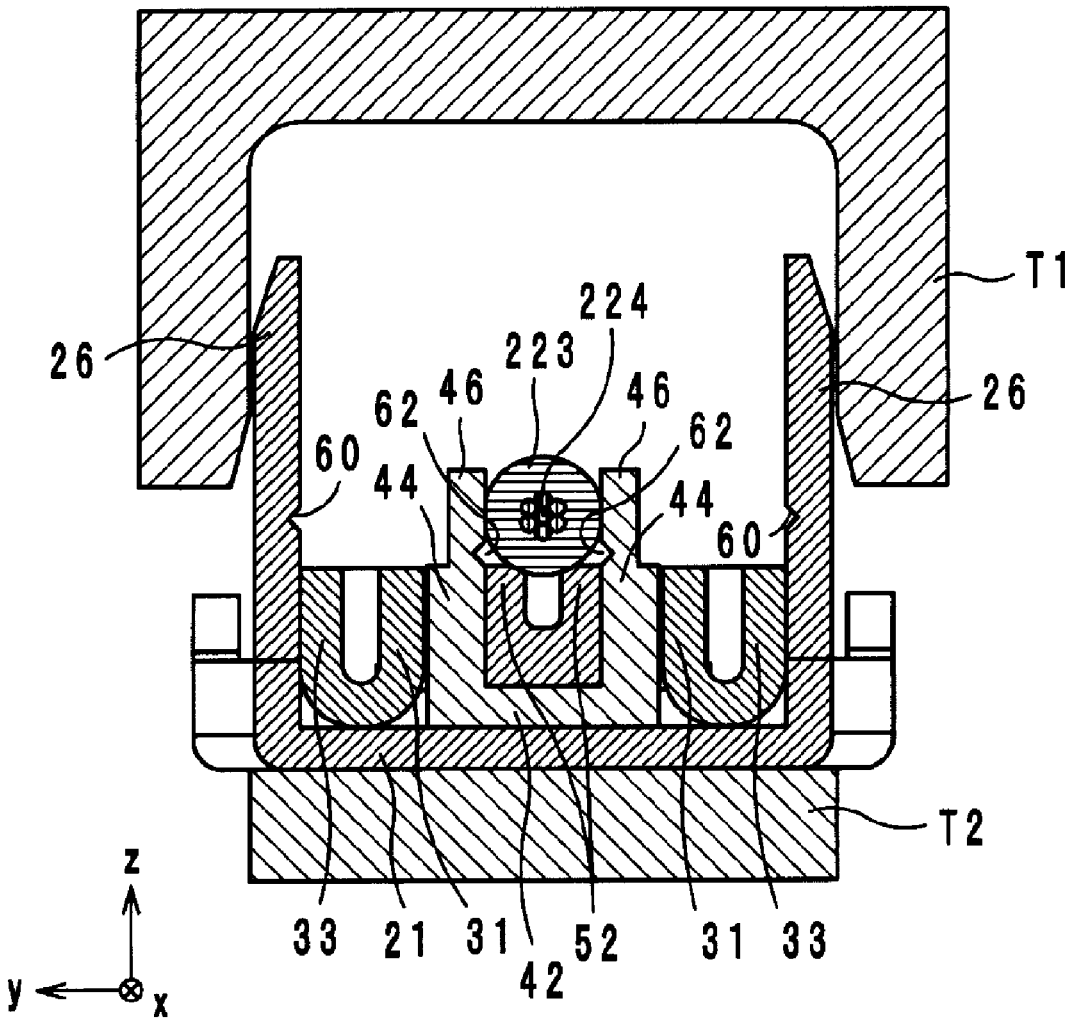
FIG. 8 illustrates a cross-sectional view of the L-type coaxial connector shown in FIG. 1 in the process of being assembled.
Figure 9:
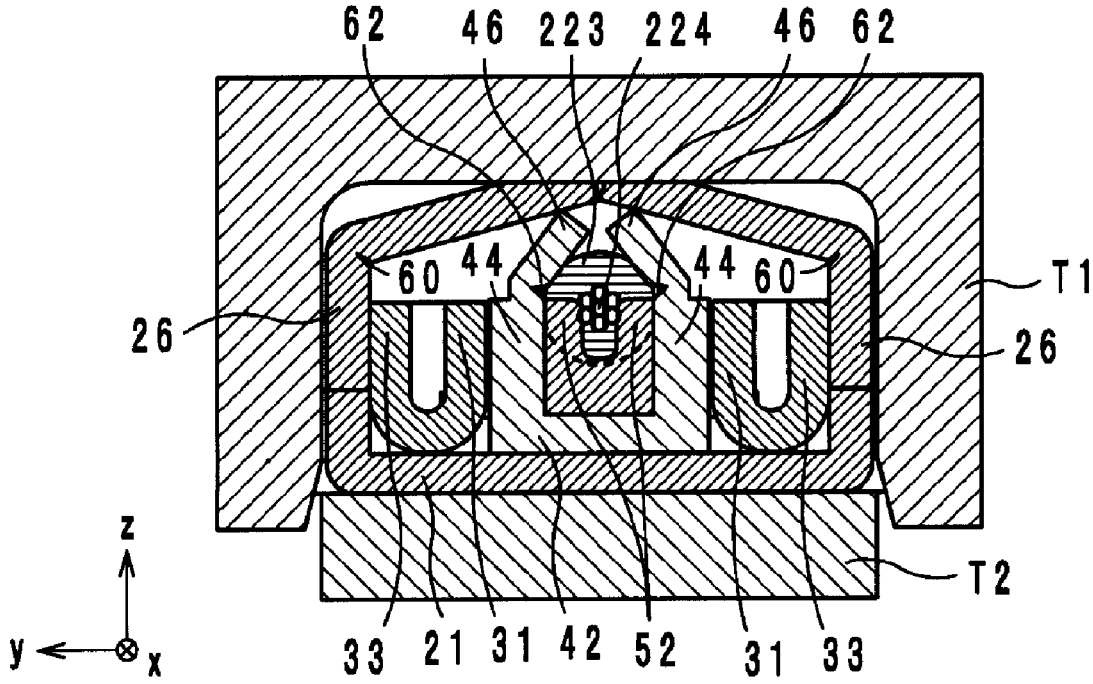
FIG. 9 is a cross-sectional view of the L-type coaxial connector shown in FIG. 1 in the process of being assembled.
Figure 10:
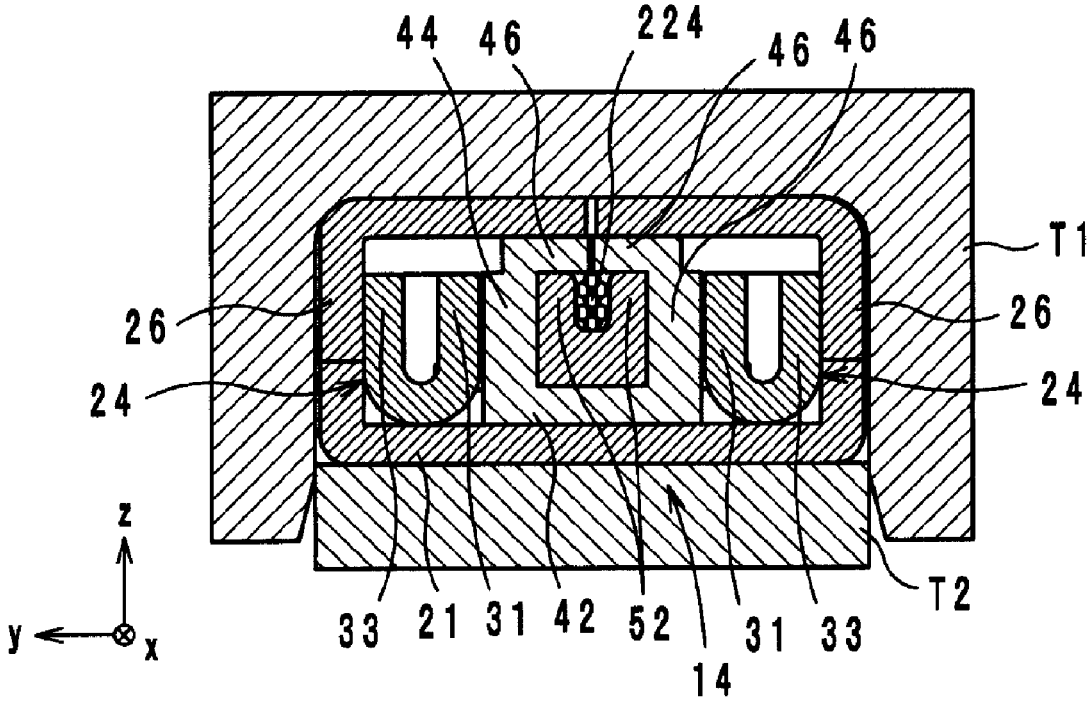
FIG. 10 is a cross-sectional view of the L-type coaxial connector shown in FIG. 1 in the process of being assembled.

FIGS. 6 and 7 are exploded perspective views of the L-type coaxial connector 10 during assembling. FIGS. 8 to 10 are sectional views of the L-type coaxial connector 10 during assembling.

First, as shown in FIG. 6, the bushing 14 is attached to the housing 12. Specifically, the bushing 14 is pressed into the housing 12 from the positive Z-direction so that the cylinder portion 20 is contained in the circular portion 36, and the holding portion 38 is disposed between the supporting portions 31. At this time, the protruding portions 40 are inserted into the recessed portions of the cylinder portion 20, as shown in FIG. 5.

Next, as shown in FIGS. 6 and 7, the socket 16 is attached to the bushing 14. Specifically, the socket 16 is attached to the bushing 14 from the positive Z-direction so that the cylinder portion 41 is contained in the cylinder portion 48, and so that the back portion 50 and attaching portion 52 are disposed between the supporting portions 44. In FIGS. 6 and 7, only one of the supporting portions 44 is shown. In this state, since the crimping portions 26 are not yet bent, the bushing 14 is exposed in the positive Z-direction.

Next, as shown in FIG. 7, the coaxial cable 220 is attached to the L-type coaxial connector 10. At this time, an end of the coaxial cable 220 has been stripped so that the outer conductor 222 and the insulating film 223 are exposed. However, the center conductor 224 is not exposed. The coaxial cable 220 is placed on the L-type coaxial connector 10 so that the insulating film 223 is disposed on the attaching portion 52, the outer conductor 222 is disposed between the crimping portions 28, and the insulating film 221 is disposed between the crimping portions 30.

After the coaxial cable 220 has been placed on the L-type coaxial connector 10, a process of crimping the crimping portions 26, 28, and 30 is performed. As shown in FIGS. 8 and 10, the crimping process is performed by using jigs T1 and T2. First, the L-type coaxial connector 10 is placed on the jig T2. Next, as shown in FIG. 8, the jig T1 is lowered from the positive Z-direction. As shown in FIG. 8, the jig T1 has a substantially angular U-shaped cross-section that is open in the negative Z-direction. The jig T1 is lowered so that the L-type coaxial connector 10 is contained in or enclosed by the jig T1.

As the jig T1 is lowered, the crimping portions 26 contact the jig T1. As shown in FIG. 8, grooves 60 are formed in the crimping portions 26. Therefore, when the jig T1 applies a force from the positive Z-direction, the crimping portions 26 are bent at the grooves 60.

As shown in FIG. 9, when the jig T1 is lowered further, the crimping portions 26 contact the lid portions 46. As shown in FIG. 8, grooves 62 are formed between the supporting portions 44 and the lid portions 46. Therefore, when the crimping portions 26 apply a force to the lid portions 46 from the positive Z-direction, the lid portions 46 are bent at the grooves 62 as shown in FIG. 9.

When the lid portions 46 are bent, the lid portions 46 press the insulating film 223 of the coaxial cable 220 against the attaching portion 52. At this time, a part of the insulating film 223 is cut by the attaching portion 52. Thus, as shown in FIG. 9, the center conductor 224 of the coaxial cable 220 enters the gap in the attaching portion 52.

As shown in FIG. 10, when the jig T1 is lowered further, the crimping portions 26 are closed and the lid portions 46 are closed. At this time, the crimping portions 26 are bent so that the crimping portions face the back portion 21 with the bushing 14 and the fastening portions 24 therebetween, whereby the bushing 14 is fixed to the housing 12. The fastening portions 24 are disposed between the bushing 14 and the crimping portions 26 in a Y-direction. The elastic portions 33 are in pressed contact with the crimping portions 26.

The center conductor 224 of the coaxial cable 220 is disposed in the gap in the attaching portion 52. Thus, the socket 16 is electrically connected to the center conductor 224.

In the process of crimping the crimping portions 26, the crimping portions 28 and 30 can be simultaneously crimped. The crimping portions 28 are crimped so as to surround the outer conductor 222. Thus, the outer conductor 222 is electrically connected to the housing 12 at the crimping portions 28. Moreover, the crimping portions 30 are crimped so as to surround the insulating film 221. Through the above-described process, the L-type coaxial connector 10 is provided with the structure shown in FIG. 1.

Next, how the L-type coaxial connector 10 can be connected to and disconnected from the receptacle 230 is described.

Figure 17:
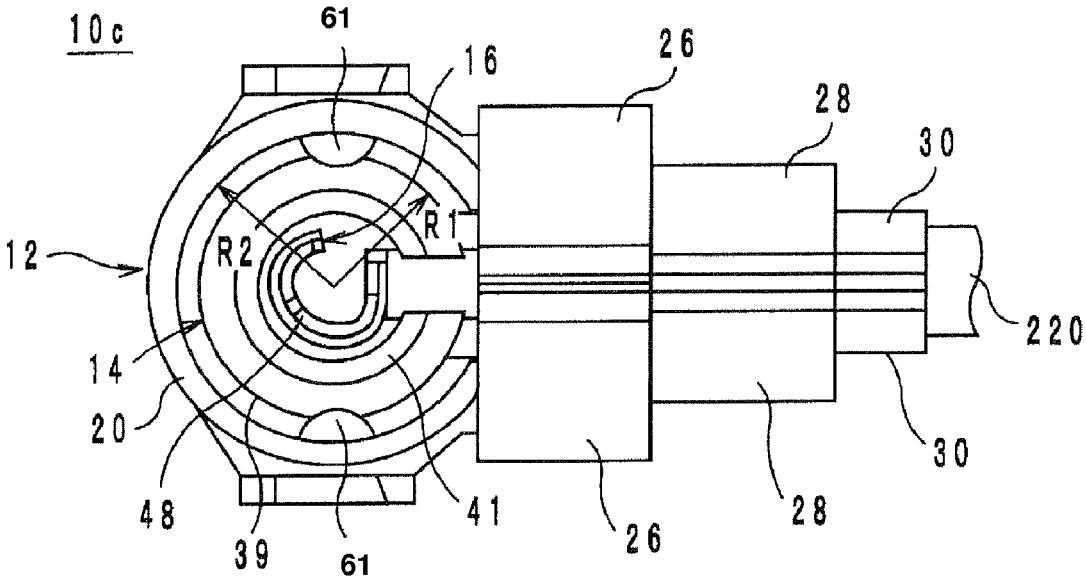
FIG. 17 is a plan view of the L-type coaxial connector according to a third modification.

As shown in FIG. 17, the receptacle 230 includes the external conductor 232 and the center conductor 234. The external conductor 232 is an electrode having a substantially cylindrical shape. The center conductor 234 is an electrode extending along the axis of the external conductor 232.

As shown in FIGS. 3A and 3B, to connect the L-type coaxial connector 10 to the receptacle 230, the external conductor 232 is inserted through the opening 01 into the cylinder portion 20. Thus, the inner periphery of the cylinder portion 20 contacts the outer periphery of the external conductor 232, so that the outer conductor 222 of the coaxial cable 220 is electrically connected the external conductor 232 of the receptacle 230 through the housing 12. At this time, the cylinder portion 20 is expanded by the external conductor 232. Thus, the inner periphery of the cylinder portion 20 is pressed into contact with the outer periphery of the external conductor 232, whereby the L-type coaxial connector 10 is prevented from being easily disconnected from the receptacle 230.

As shown in FIGS. 3A and 3B, at the same time when the external conductor 232 is inserted into the cylinder portion 20, the center conductor 234 is inserted into the cylinder portion 48 of the socket 16. Thus, the outer periphery of the center conductor 234 contacts the inner periphery of the cylinder portion 48, so that the center conductor 224 of the coaxial cable 220 is electrically connected to the center conductor 234 of the receptacle 230 through the socket 16.

The L-type coaxial connector 10 having the above-described structure can be attached to and detached from the receptacle with a moderate force, as described below. In the following description, how the cylinder portions 20, 226, and 326 are expanded by the external conductor 232 while the external conductor 232 of the receptacle 230 is inserted is described using a model.

Figure 11A:
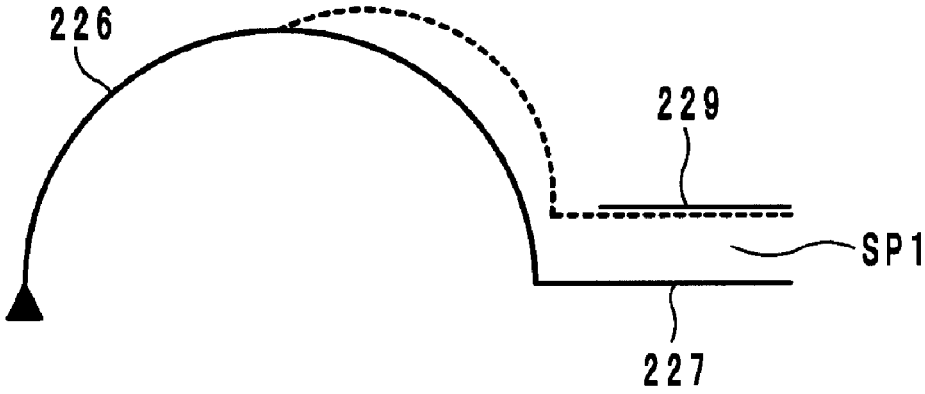
FIG. 11A is a model of a coaxial connector shown in FIG. 20.
Figure 11B:
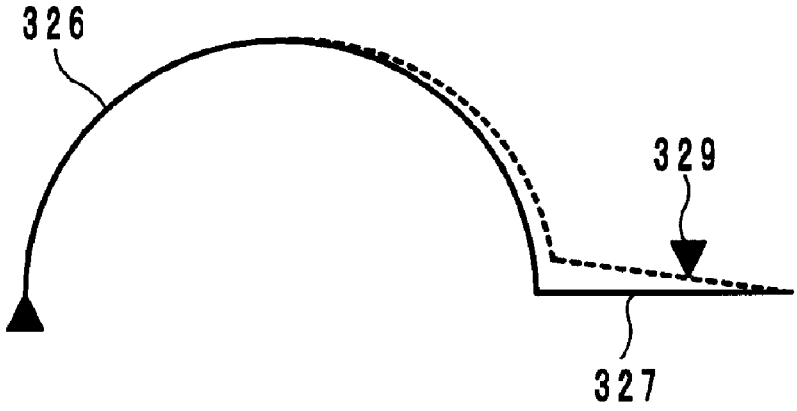
FIG. 11B is a model of a coaxial connector shown in FIG. 21.
Figure 11C:
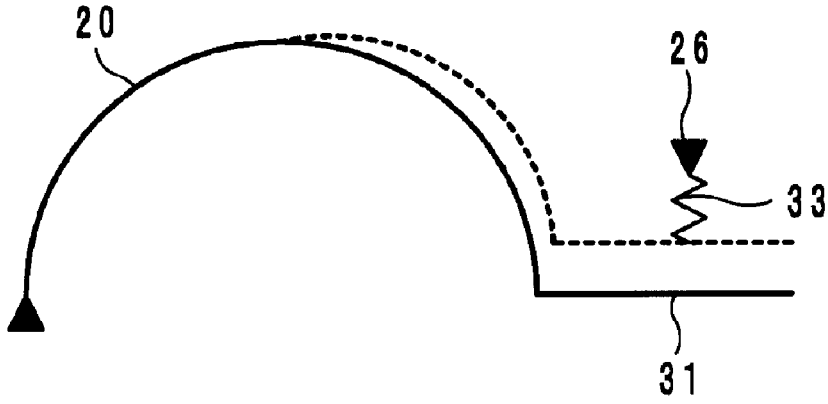
FIG. 11C is a model of the L-type coaxial connector shown in FIG. 1.
Figure 20:
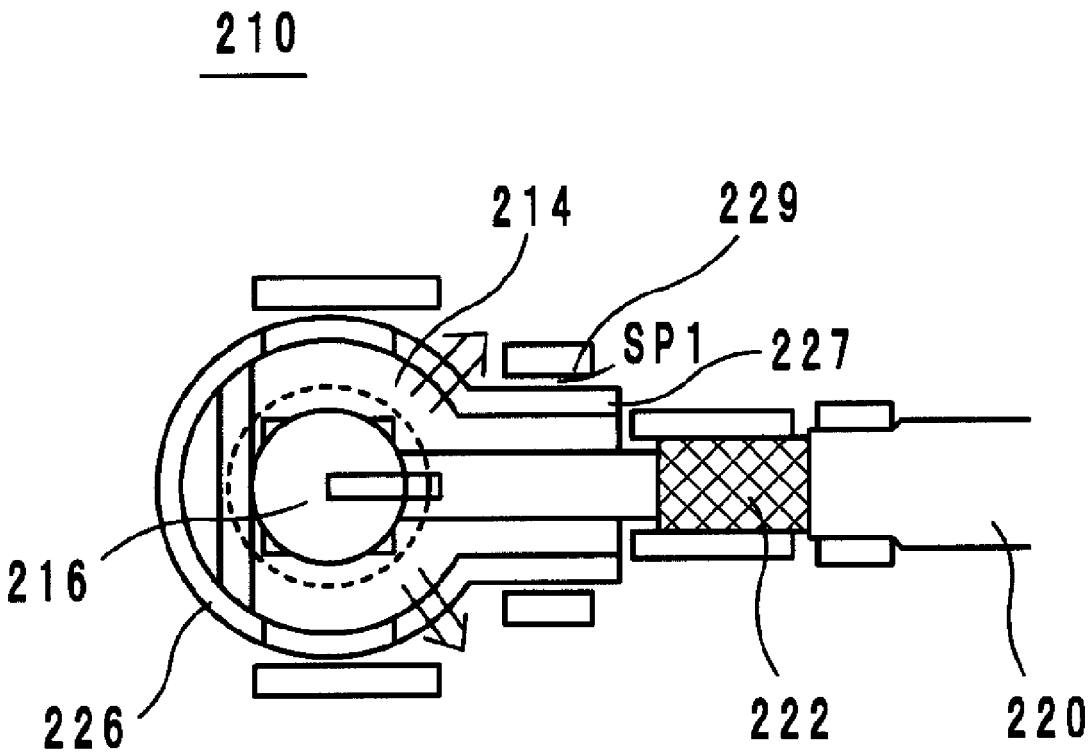
FIG. 20 is a plan view of the coaxial connector shown in FIG. 18.

Specifically, FIG. 11A shows a model of the prior art coaxial connector 210 shown in FIG. 20. FIG. 11B shows a model of the prior art coaxial connector 310 shown in FIG. 21. FIG. 11C shows a model of the L-type coaxial connector 10 of the present invention shown in FIG. 1. In the models, only the upper half of each of the housings 12, 212, and 312 is illustrated.

As shown in FIG. 20, in the coaxial connector 210, because the gap SP1 is present between the surrounding portion 227 and the crimping portion 229, the surrounding portion 227 is not fixed. Accordingly, the cylinder portion 226 and the surrounding portion 227 constitute a cantilever, as shown in FIG. 11A, so the surrounding portion 227 is deformed even with a relatively small force. Because of this, in inserting the external conductor 232 of the receptacle 230 into the coaxial connector 210, the cylinder portion 226 and the surrounding portion 227 are largely deformed, as indicated by the dotted lines shown in FIG. 11A. As a result, the force for causing the cylinder portion 226 to be pressed into contact with the external conductor 232 is insufficient, so the coaxial connector 210 is easily disengaged from the receptacle 230.

Figure 21:
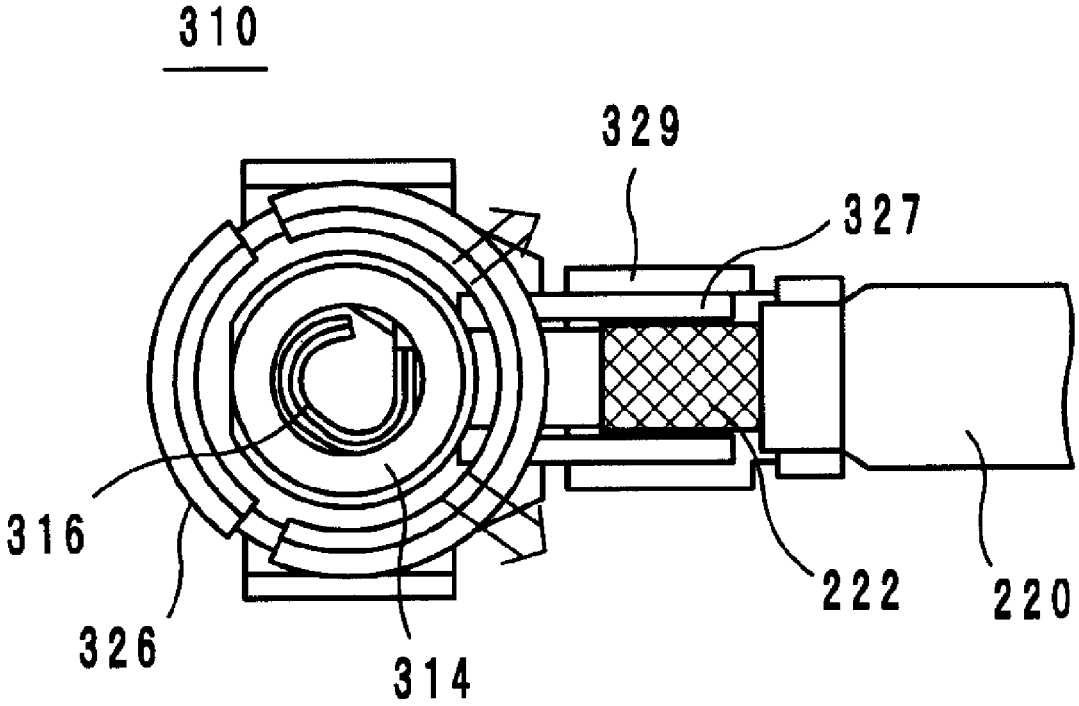
FIG. 21 is a plan view of the coaxial connector shown in FIG. 19.

As shown in FIG. 21, in the coaxial connector 310, because the crimping portion 329 is pressed into contact with the cover 327, the cover 327 is fixed. Accordingly, the cylinder portion 326 and the cover 327 constitute a supporting beam on each side thereof, as shown in FIG. 11B, so the cover 327 is not deformed unless a large force is applied. That is, the cylinder portion 326 can be deformed in a narrow range. Thus, in order to enable the coaxial connector 310 to be attached to and detached from the receptacle 230 with a moderate force, it is necessary to design the housing 312 such that the amount of deformation of the cylinder portion 326 occurring when the external conductor 232 of the receptacle 230 is inserted into the cylinder portion 326 falls within that narrow range. Therefore, the coaxial connector 310 has a problem in which the housing 312 must be produced with high accuracy.

In contrast, in the L-type coaxial connector 10 of the present invention, the elastic portion 33 is disposed between the crimping portion 26 and the supporting portion 31 connected to the cylinder portion 20. The supporting portion 31 and the elastic portion 33 have a substantially U shape, so the distance between the supporting unit 31 and the elastic portion 33 can be changed by elastic deformation. Accordingly, as shown in FIG. 11C, the cylinder portion 20 and the supporting portion 31 are fixed at a first end, and they are fixed at a second end through the elastic portion 33. Therefore, the cylinder portion 20 of the L-type coaxial connector 10 is less deformable than the cylinder portion 226 of the coaxial connector 210 and is deformable more easily than the cylinder portion 326 of the coaxial connector 310. As a result, for the L-type coaxial connector 10, it is easy to set the force for causing the cylinder portion 20 to be pressed into contact with the external conductor 232 at an appropriate magnitude. Therefore, the L-type coaxial connector 10 can be connected to and disconnected from the receptacle with a moderate force.

The L-type coaxial connector 10 of the present invention can be manufactured advantageously at low cost as described below. More specifically, as shown in FIG. 5, with the L-type coaxial connector 10, the radius R1 of the back portion 39 is equal to or smaller than the radius R2 of the cylinder portion 20. Therefore, the back portion 39 can pass through the opening 01 of the cylinder portion 20 from the positive z-direction. That is, the back portion 39 can be attached from the positive z-direction. Moreover, the crimping portions 26 are bent so as to face the back portion 21 with the bushing 14 therebetween and to fix the bushing 14 and to the housing 12. Accordingly, before the crimping portions 26 are bent, the holding portion 38 of the bushing 14 is exposed in the positive Z-direction, as shown in FIG. 2. Thus, the holding portion 38 of the bushing 14 can be attached to the housing 12 from the positive Z-direction. Therefore, with the L-type coaxial connector 10, the bushing 14 can be attached to the housing 12 from the positive Z-direction.

Since the bushing 14 can be attached to the housing 12 from the positive Z-direction, even when the opening 02 of the cylinder portion 20 is covered by the back portion 21 as shown in FIG. 2, the bushing 14 can be attached to the housing 12. Therefore, with the L-type coaxial connector 10, the process of manufacturing the housing 12 as shown in FIG. 4 and the process of bending the back portion 21 can be advantageously and continuously performed on one manufacturing line. As a result, the L-type coaxial connector 10 can be manufactured at low costs.

Moreover, with the L-type coaxial connector 10, the housing 12 can be assembled with high precision as described hereinafter. However, before discussing further advantages of the present invention, the manufacturing of the prior art connector shown in FIG. 18, for example, is discussed immediately below.

Figure 18:
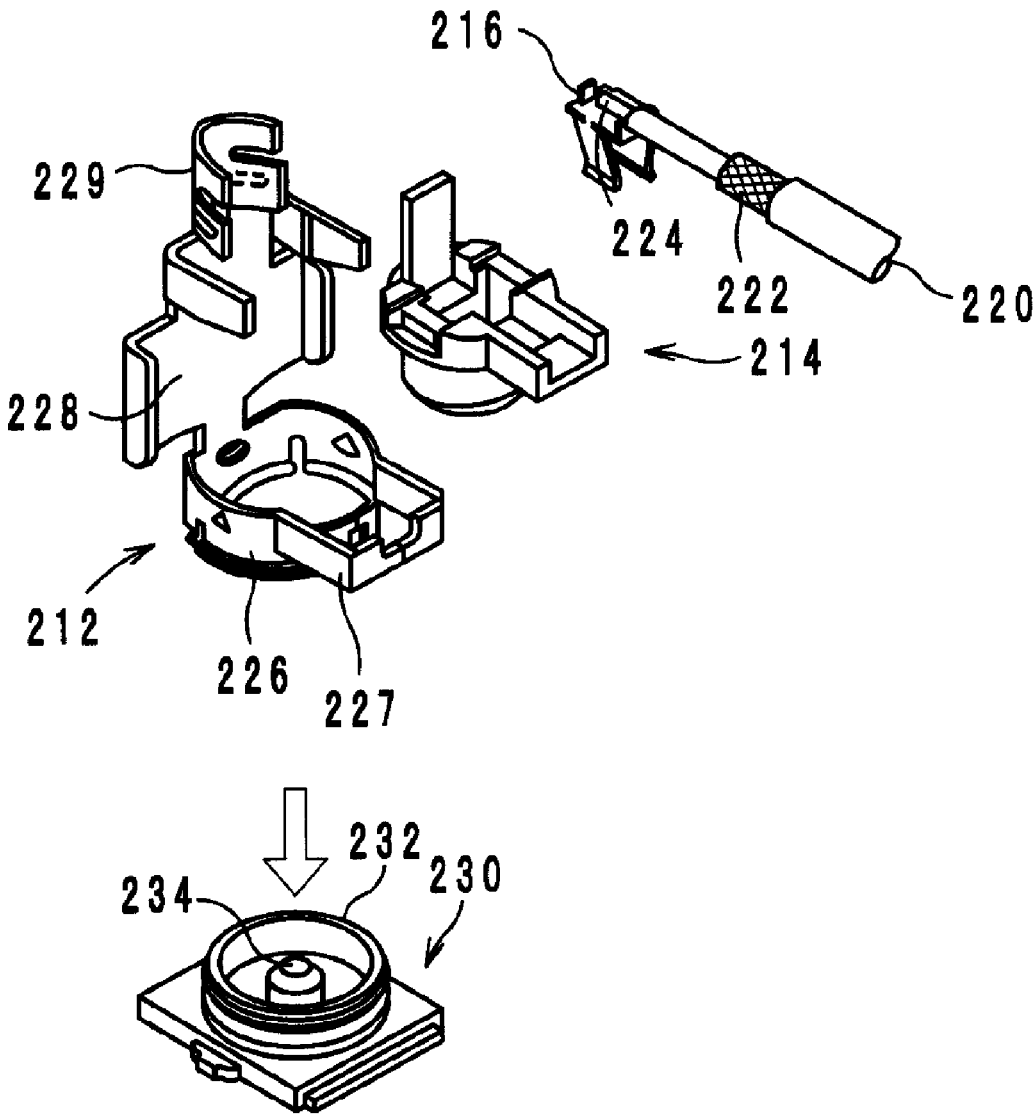
FIG. 18 is an exploded perspective view of a coaxial connector and a receptacle described in JP 2001-43939.
Figure 19:
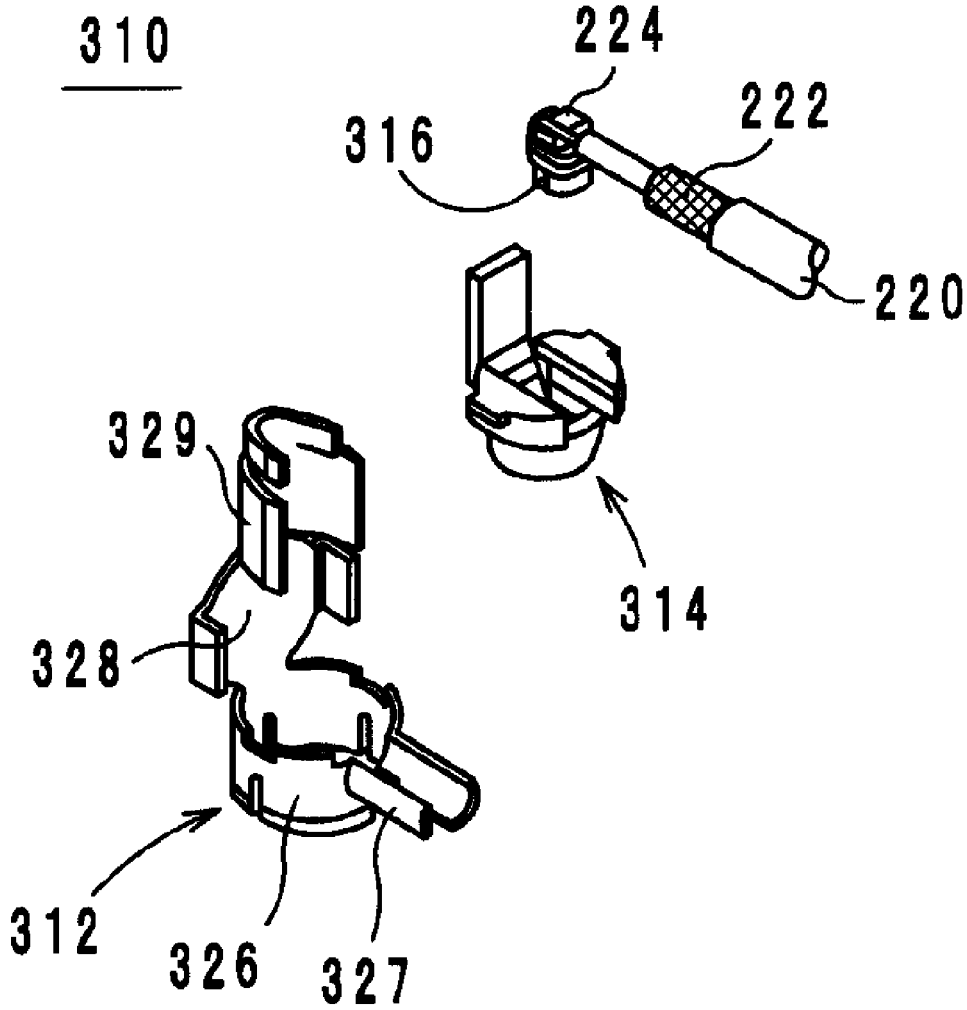
FIG. 19 is an exploded perspective view of a coaxial connector described in JP 11-307158.

In manufacturing the coaxial connector 210, the process of making the housing 212 shown in FIG. 18 and the process of closing the lid portion 228 of the housing 212 are performed by different operators. Specifically, the housing 212 is made by an operator specializing in presswork, while the process of closing the lid portion 228 is performed by an operator who does not specialize in presswork (i.e., the manufacturer of the coaxial connector 210). An operator who specializes in presswork can perform metalworking, such as closing the lid portion 228, more precisely than an operator who does not specialize in presswork. Therefore, in manufacturing the coaxial connector 210, it is desirable that the process of closing the lid portion 228 of the housing 212 be performed by an operator specializing in presswork.

However, it is not preferable that an operator specializing in presswork perform the process of closing the lid portion 228 in terms of manufacturing costs. Specifically, the process of closing the lid portion 228 is performed after the bushing 214 and the like have been attached. Therefore, with the coaxial connector 210, in order to allow an operator specializing in presswork to close the lid portion 228, a half-finished product of the coaxial connector 210 has to be delivered to the operator specializing in presswork after an operator who does not specialize in presswork has attached the bushing 214 and the like. Thus, half-finished products of the coaxial connector 210 have to be delivered between an operator specializing in presswork and an operator who does not specialize in presswork, which may result in a substantial increase in manufacturing costs.

On the other hand, according to the present invention, with the L-type coaxial connector 10, the bushing 14 and the socket 16 can be attached to the housing after the back portion 21 has been bent. Thus, a manufacturer of the L-type coaxial connector 10 can make the L-type coaxial connector 10 by purchasing the housing 12, which has the back portion 21 being bent, such as shown in FIG. 2, and attaching the bushing 14 and the socket 16 to the housing 12. That is, the process of bending the back portion 21 of the housing 12 is performed by an operator specializing in presswork. As a result, with the L-type coaxial connector 10, the housing 12 can be assembled with high precision.

Moreover, the L-type coaxial connector 10 has the recessed portions 32 and the protruding portions 34 as shown in FIG. 4. The recessed portions 32 engage with the protruding portions 34, and the crimping portions 26 are fixed to the fastening portions 24. As a result, as shown in FIG. 2, even in a state in which the crimping portions 26 have not been crimped, the housing 12 can maintain a state in which the back portion 21 is bent and the back portion 21 covers the opening 02.

Figure 12:
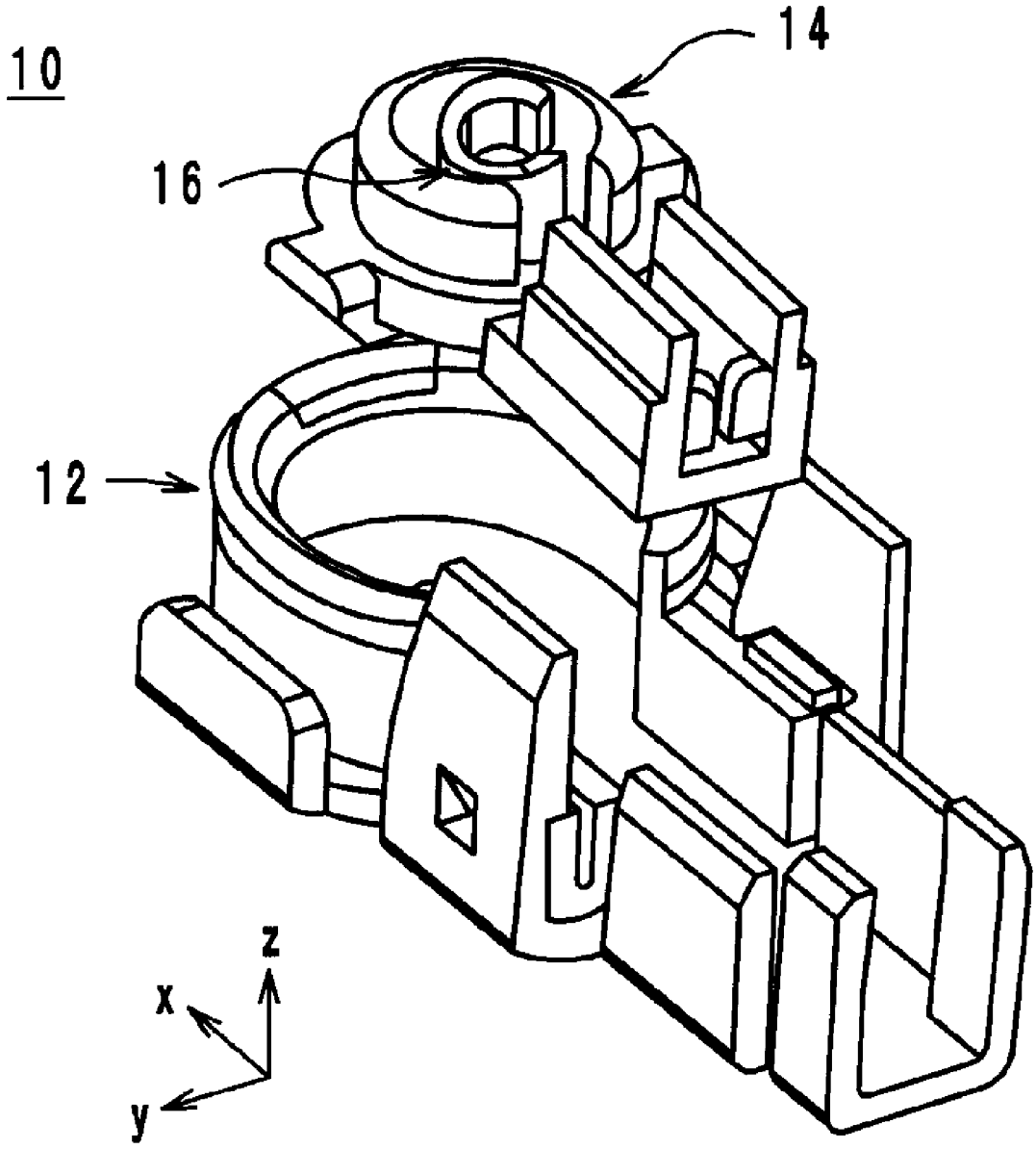
FIG. 12 is an exploded perspective view of the L-type coaxial connector during assembling by another assembling method.
Figure 13:
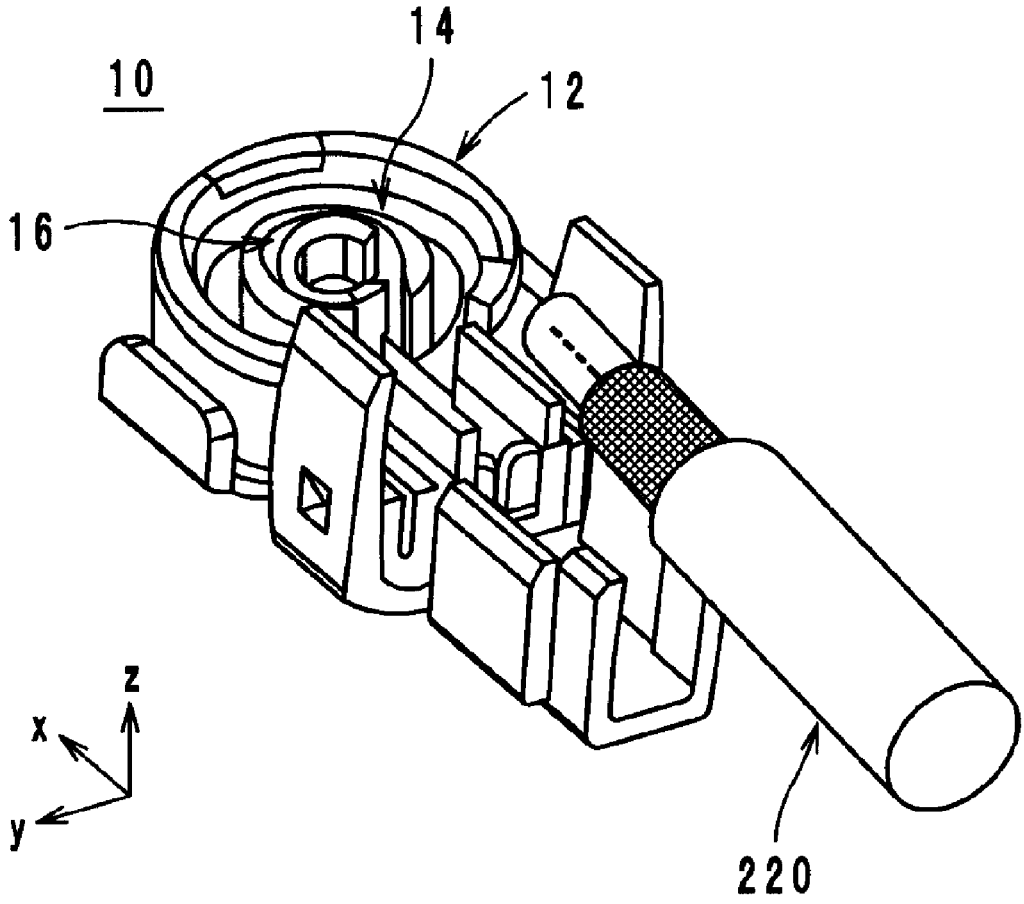
FIG. 13 is an exploded perspective view of the L-type coaxial connector during assembling by another assembling method.

The L-type coaxial connector 10 is not limited to the above-described embodiment. The L-type coaxial connector 10 can be modified within the spirit of the above-described embodiment of the present invention. Hereinafter, modifications of the L-type coaxial connector 10 are described with reference to the drawings. FIGS. 12 and 13 are exploded perspective views of the L-type coaxial connector 10 during assembling by other assembling methods.

In the above-described embodiment, the bushing 14 is attached to the housing 12, and then the socket 16 is attached to the bushing 14, as shown in FIGS. 6 and 7. However, the bushing 14 and the socket 16 may be assembled in a different order. For example, the socket 16 may be first attached to the bushing 14 as shown in FIG. 12, and then the bushing 14 may be attached to the housing 12 as shown in FIG. 13.

As shown in FIG. 2, the cylinder portion 41 of the bushing 14 has a cutout. This cutout allows the socket 16 to be attached to the bushing 14 from the positive Z-direction. However, with the bushing 14, the socket 16 and the external conductor 232 may short-circuit at a position A shown in FIG. 3B. Specifically, since the cylinder portion 41 has a cutout, the back portion 50 of the socket 16 is exposed in the positive Z-direction at the cutout. When the receptacle 230 is attached to the L-type coaxial connector 10 having the socket 16, the back portion 50 is disposed close to the external conductor 232 at a position at which the back portion 50 is exposed. As a result, when, for example, the L-type coaxial connector 10 is forcefully pressed against the receptacle 230, the socket 16 and the external conductor 232 may short-circuit. Therefore, modification is possible to avoid such a possibility of a short-circuit.

Figure 14:
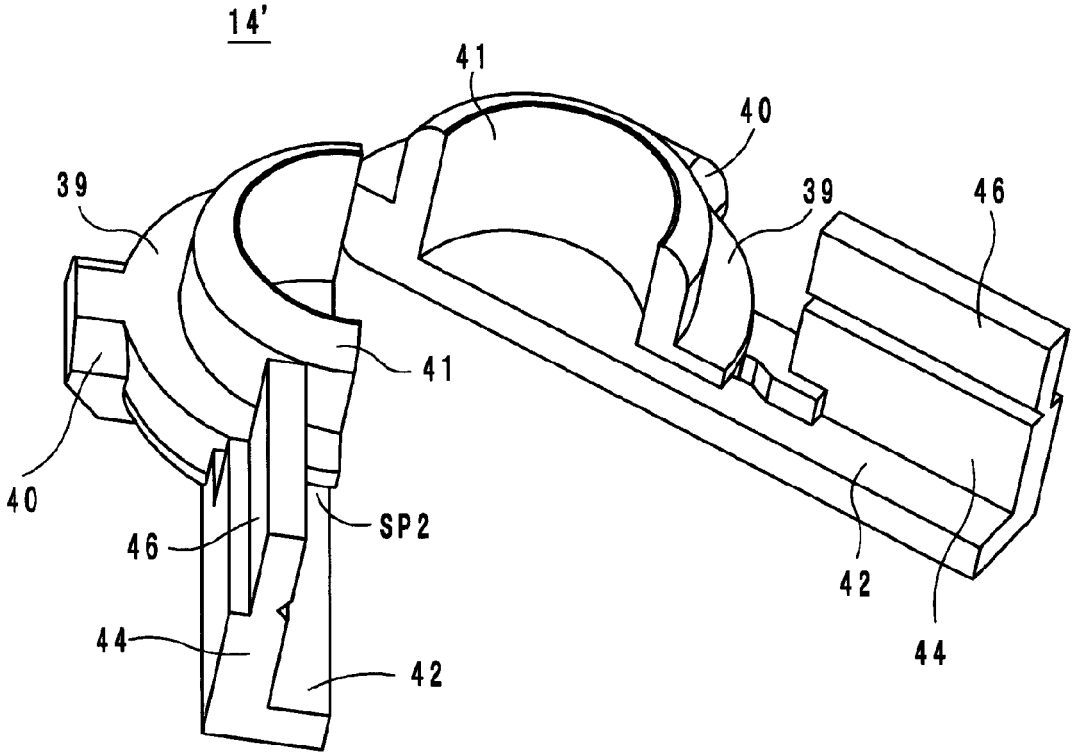
FIG. 14 is an external perspective view of a bushing according to a modification.

To avoid possible short-circuiting, a bushing 14', which is shown in an external perspective view of FIG. 14, may be used. The bushing 14' shown in FIG. 14 does not have a cutout in the cylinder portion 41. Instead, the bushing 14' is divided into two portions by an XZ-plane. Moreover, gaps SP2 are formed between the bottom surface of the cylinder portion 41 and the upper surface of the back portion 42. The socket 16 is placed on the back portion 42 so that the socket extends through the gaps SP2. Then, the two divided portions of the bushing 14' are mated. Thereafter, the bushing 14' and the coaxial cable 220 are attached to the housing 12 by a process similar that shown in FIGS. 11 and 12. Lastly, the crimping portions 26, 28, and 30 are crimped so as to complete assembling of the L-type coaxial connector 10.

Since the cylinder portion 41 of the bushing 14' shown in FIG. 14 does not have a cutout, the back portion of the socket 16 is not exposed in the positive Z-direction. Thus, even when, for example, the L-type coaxial connector 10 is strongly pressed against the receptacle 230, the socket 16 and the external conductor 232 do not short-circuit. In using the bushing 14', it is necessary to attach the bushing 14' to the housing 12 after the socket 16 has been attached to the bushing 14'.

Figure 15:
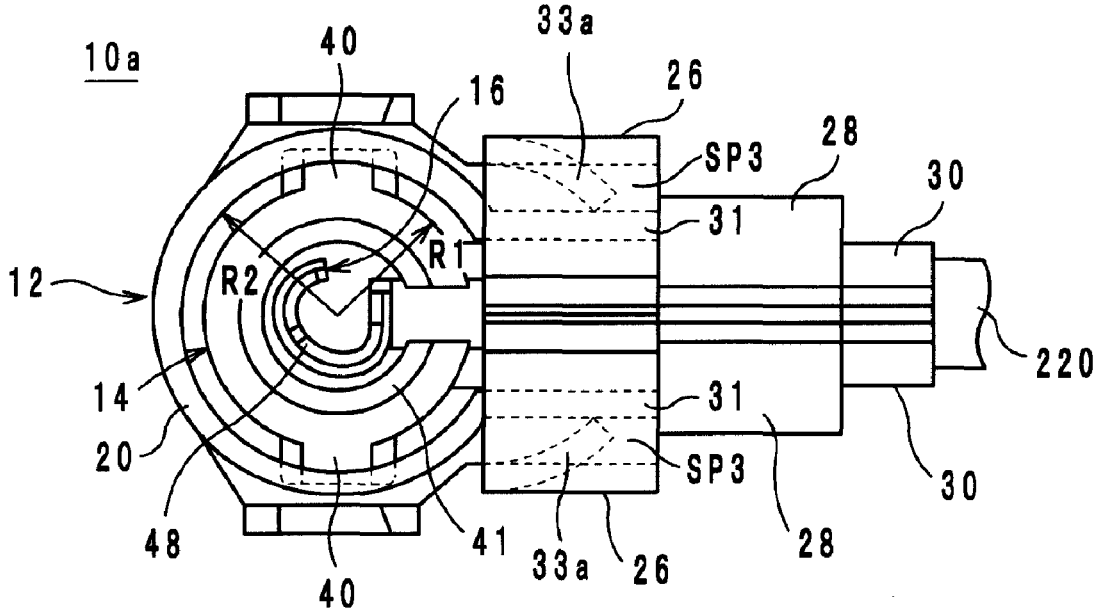
FIG. 15 is a plan view of the L-type coaxial connector according to a first modification.
Figure 16:
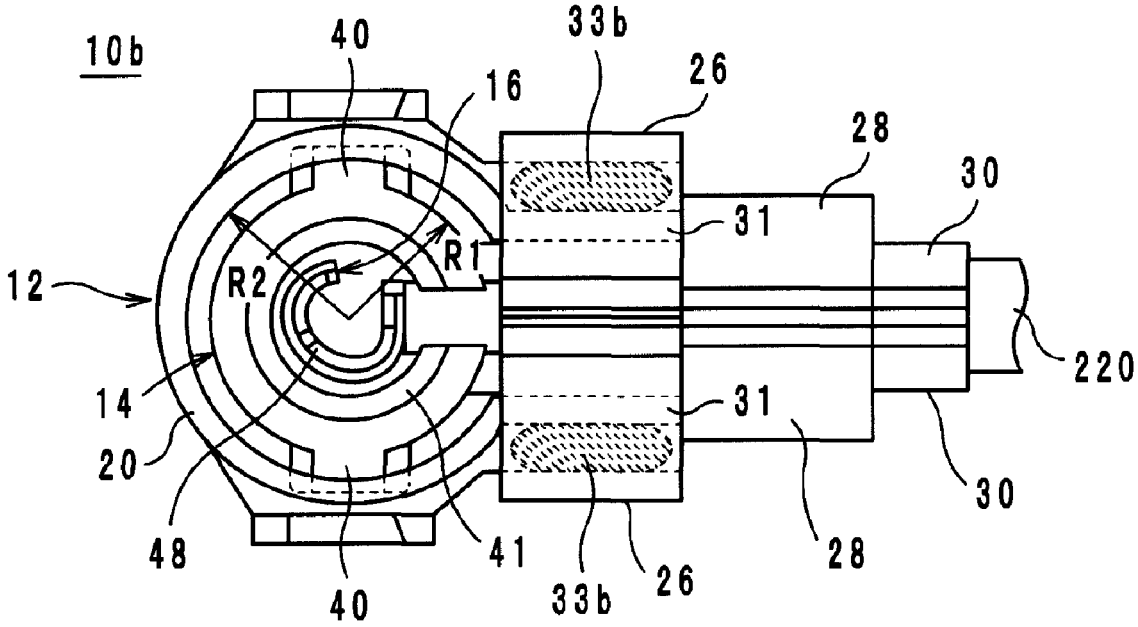
FIG. 16 is a plan view of the L-type coaxial connector according to a second modification.

As shown in FIG. 2, with the L-type coaxial connector 10 according to the above-described embodiment, the elastic portions 33 is are made by bending the supporting portions 31 into a substantial U-shapes. However, the structure of the elastic portions 33 is not limited thereto. FIG. 15 is a plan view of an L-type coaxial connector 10*a* according to a first modification. FIG. 16 is a plan view of an L-type coaxial connector 10*b* according to a second modification.

In the L-type coaxial connector 10*a*, the crimping portions 26 and the supporting portions 31 are plate-shaped members disposed with gaps SP3 therebetween. The crimping portions 26 include elastic portions 33*a*. To be specific, the elastic portions 33*a* are made by bending parts of the crimping portions 26, and the elastic portions are in pressed contact with the supporting portions 31. With the L-type coaxial connector 10*a*, as with the L-type coaxial connector 10, an elastic force can be applied between the crimping portions 26 and the supporting portions 31, so that the cylinder portion 20 can be easily pressed into contact with the external conductor 232 with an appropriate force. As a result, the L-type coaxial connector 10*a* can be connected to and disconnected from a receptacle with an appropriate force.

With the L-type coaxial connector 10*a* shown in FIG. 15, the elastic portions 33*a* are made by bending parts of the crimping portions 26, and the elastic portions 33*a* are pressed into contact with the supporting portions 31. However, for example, the elastic portions 33*a* may be made by bending parts of the supporting portions 31, and the elastic portions 33*a* may be pressed into contact with the crimping portions 26.

The elastic portions 33 may be formed as members independent of the housing 12, such as elastic portions 33*b* as shown in FIG. 16. The elastic portions 33*b* are elastic members made of elastomer, and disposed between the crimping portions 26 and the supporting portions 31.

With the L-type coaxial connector 10*b*, as with the L-type coaxial connector 10, an elastic force can be applied between the crimping portions 26 and the supporting portions 31, so that the cylinder portion 20 can be easily pressed into contact with the external conductor 232 with an appropriate force. As a result, the L-type coaxial connector 10*b* can be connected to and disconnected from a receptacle with an appropriate force.

As shown in FIG. 5, with the L-type coaxial connector 10 of the above-described embodiment, the protruding portions 40 protruding from the back portion 39 and the recessed portions in the inner periphery of the cylinder portion 20 engage with each other, so that the bushing 14 is prevented from dropping off the housing 12. However, a structure for preventing the bushing 14 from dropping off the housing 12 is not limited thereto. FIG. 16 is a plan view of an L-type coaxial connector 10*c* according to a third modification.

As shown in FIG. 17, the housing 12 may further include protruding portions 61 protruding inward in the opening 01 of the cylinder portion 20. With this structure, the protruding portions 61 slightly overlap the bushing 14 in plan view in a Z-direction, so that the bushing 14 can be prevented from dropping off the housing 12.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An L-type coaxial connector that can be attached to a coaxial cable and connected to and disconnected from a receptacle, the receptacle having a center conductor and an external conductor, the L-type coaxial connector comprising:

a housing;

a bushing adapted to be attached to the housing;

a socket adapted to be attached to the bushing and being connectable to the center conductor of the receptacle, the socket being insulated from the housing by the bushing; and an elastic portion, wherein the housing includes:

a cylinder portion having a first opening, a second opening, and a cut out portion, the cylinder portion being adapted to be attached to the external conductor inserted from the first opening;

a back portion covering the second opening;

a supporting portion disposed on the cylinder portion; and a crimping portion extending from the back portion and adapted to being bent so as to face the back portion such that the supporting portion is disposed between the crimping portion and the back portion, and wherein the elastic portion is disposed between the crimping portion and the supporting portion, and wherein the elastic portion is in pressed contact with the crimping portion.

2. The L-type coaxial connector according to claim 1, wherein the elastic portion is a plate connected to the supporting portion and that faces the supporting portion and is pressed into contact with the crimping portion.

3. The L-type coaxial connector according to claim 1, wherein the crimping portion and the supporting portion are plates arranged so as to have a gap therebetween, and wherein the elastic portion is a plate connected to the crimping portion, bent from the crimping portion, and pressed into contact with the supporting portion.

4. The L-type coaxial connector according to claim 1, wherein the elastic portion is made of an elastomer.

5. The L-type coaxial connector according to claim 2, wherein the elastic portion is made of an elastomer.

6. The L-type coaxial connector according to claim 3, wherein the elastic portion is made of an elastomer.

* * * * *